US006817893B2

(12) United States Patent
Schmid et al.

(10) Patent No.: US 6,817,893 B2
(45) Date of Patent: Nov. 16, 2004

(54) PLUG CONNECTOR FOR CONNECTION WITH A BATTERY TERMINAL

(75) Inventors: Alexander Schmid, Alsbach-Haehnlein (DE); Rolf Jetter, Darmstadt (DE); Antonio Lehner, Wiesbaden (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 10/758,789

(22) Filed: Jan. 16, 2004

(65) Prior Publication Data

US 2004/0192120 A1 Sep. 30, 2004

(30) Foreign Application Priority Data

Jan. 20, 2003 (EP) ..... 03001122

(51) Int. Cl.[7] ..... H01R 13/52
(52) U.S. Cl. ..... 439/522; 439/759; 439/840
(58) Field of Search ..... 439/202, 519, 439/521, 522, 759, 760, 761, 840, 892

(56) References Cited

U.S. PATENT DOCUMENTS 5,346,407 A * 9/1994 Hood ..... 439/522
5,439,759 A * 8/1995 Lippert et al. ..... 429/65
5,576,516 A * 11/1996 Kameyama et al. ..... 174/138 F
6,426,465 B1 * 7/2002 Kosuge ..... 174/138 F

FOREIGN PATENT DOCUMENTS

DE 197 18 448 A1 11/1998

* cited by examiner

*Primary Examiner*—Thanh-Tam Le
(74) *Attorney, Agent, or Firm*—Barley Snyder

(57) ABSTRACT

The invention relates to a plug connector for making an electrical connection with a battery terminal. The plug connector comprises a housing formed by joining an upper shell and a lower shell with a contact lying within the housing. The contact has a helical spring contact and a contact strip bent to form a cylindrical region. The upper shell and the lower shell each have a holding element extending within the cylindrical region formed by the contact strip, in order to form a recess for holding the helical spring contact.

9 Claims, 3 Drawing Sheets

PLUG CONNECTOR FOR CONNECTION WITH A BATTERY TERMINAL

FIELD OF THE INVENTION

The invention relates to a plug connector for making an electrical connection with a battery terminal.

BACKGROUND OF THE INVENTION

In various applications, particularly in motor vehicles, a plug connector is needed to make a reliable electrical connection with a battery terminal. The electrical connection must be capable of withstanding vibrations. Moreover, the plug connector should be of simple construction and be easily placed on the battery terminal.

DE 197 18 448 A1 discloses an electrical plug connector which receives a substantially cylindrical pin part in a substantially cylindrical chamber of a socket part. An annular resilient contact element is arranged in an annular groove in the contact-making region between the pin part and the socket part. An annularly arranged helical spring serves as the contact element. The helical windings of the spring are arranged at an angle to the axis of the helix.

Because of the expected use of 36-volt and 42-volt systems in motor vehicles in future, battery contacts like those described above will no longer adequate. In such systems, a contact protection means should be provided to make direct contact with the battery terminal difficult. The battery contact should also be protected, by a housing to avoid direct contact.

It is an object of the present invention to provide a plug connector, for making contact with a battery terminal, which can be easily mounted on the battery terminal, quickly and reliably without the application of much force. For safety reasons, it should only be possible to dismantle the device with difficulty. It is a further object of the present invention to provide a plug connector which is easy to assemble and therefore can be constructed in a simple way.

These and other objects are achieved by a plug connector in accordance with an exemplary embodiment of the invention. The plug connector comprises a housing formed by joining an upper shell and a lower shell with a contact lying within the housing. The contact has a helical spring contact and a contact strip bent to form a cylindrical region. The upper shell and the lower shell each have a holding element extending within the cylindrical region formed by the contact strip, in order to form a recess for holding the helical spring contact.

BRIEF DESCRIPTION OF THE DRAWINGS

Exemplary embodiments of the invention will be described in more detail below with reference to the attached drawings, in which.

DETAILED DESCRIPTION OF THE INVENTION

Figure 1:
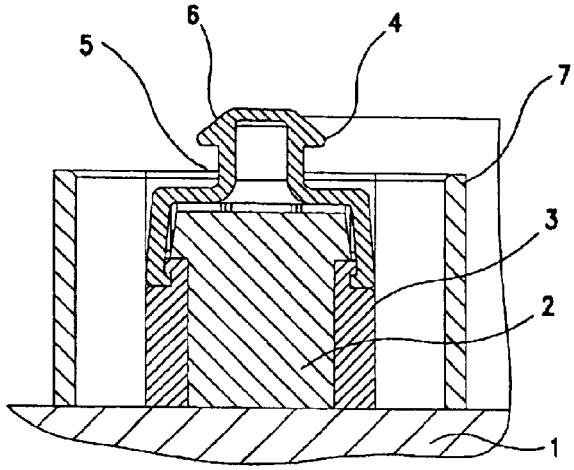
FIG. 1 shows a cross-section through a battery terminal which is to make contact by means of a plug connector according to the invention.
Figure 2:
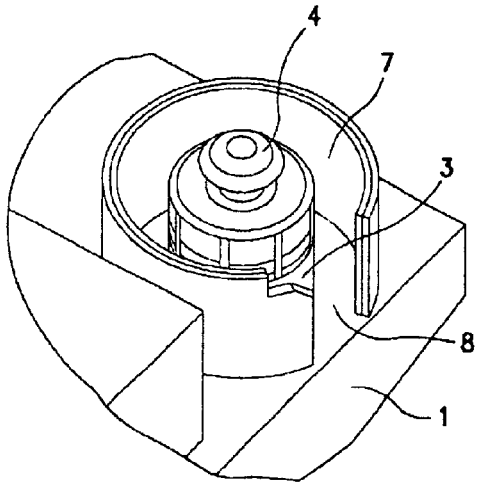
FIG. 2 shows a perspective illustration of the battery terminal in accordance with FIG. 1.

FIGS. 1 and 2 illustrate a battery terminal of a 36 volt or 42-volt battery for a motor vehicle. The terminal has a cylindrical portion or post 2 projecting out of a battery housing 1. The cylindrical portion or post 2 is surrounded at least in a region adjacent the battery housing 1 by a contact ring 3 (comprising for example, copper) and has its free end covered by a protective cap 4. The protective cap 4 is of substantially axially symmetrical construction and latches to the cylindrical portion or post 2. The protective cap 4 tapers towards its free end and has a peripheral narrowed portion 5 and an oblique face 6 between the narrowed portion 5 and the tapered free end of the protective cap 4.

Figure 3:
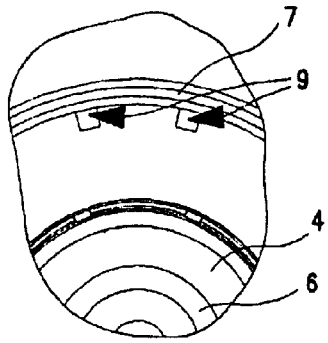
FIG. 3 shows a plan view of the battery terminal in accordance with FIG. 1.

The cylindrical portion or post 2 is surrounded by a protective ring 7, forming an annular gap or space between the cylindrical portion or post 2 and the protective ring 7. The protective ring 7 has a cut-out 8 along a portion thereof to receive a plug connector for making an electrical connection with the cylindrical portion or post 2. The protective ring 7 is configured to prevent inadvertent contact with the contact ring 3 of the battery. As illustrated in FIG. 3, one or more projections 9 may be provided on the protective ring 7 to engage in corresponding recesses in a mating plug connector associated with the cylindrical portion or post 2 surrounded by a protective ring 7. The protective ring 7 may thereby prevent the battery from making contact with unsuitable plug means (which does not have the recesses corresponding to the projections 9).

Figure 4:
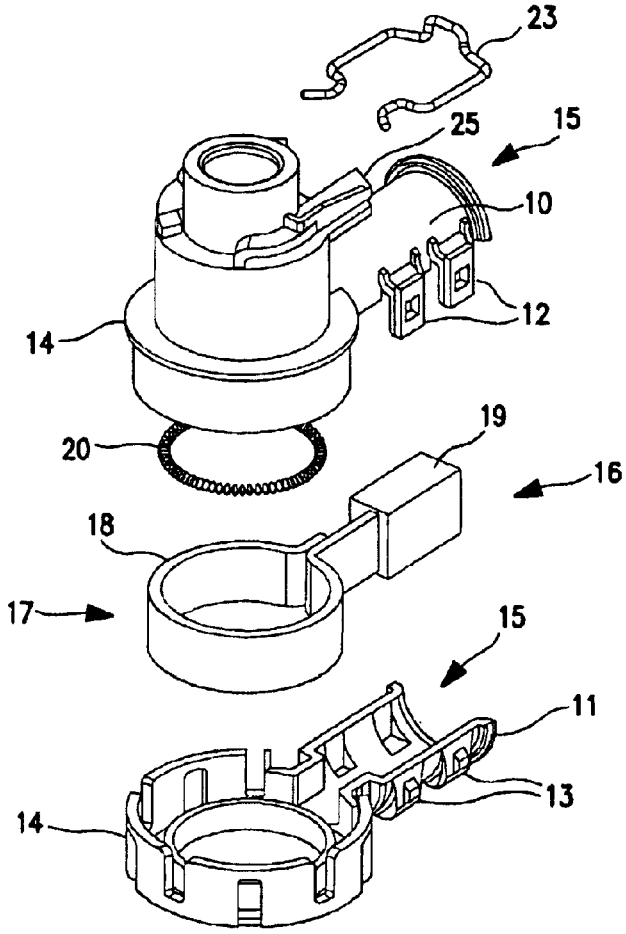
FIG. 4 shows an exploded view of the plug connector in accordance with an example embodiment of the invention.

FIG. 4 illustrates an exploded illustration of an exemplary plug connector according to the invention. The plug connector has a housing upper shell 10 and a housing lower shell 11 which may be connected to one another by way of first latching elements 12 and second latching elements 13 to form a plug connector housing. Both the housing upper shell 10 and the housing lower shell 11 have a contact region 14 which comprises a cylindrical recess in which the battery terminal is to be received. Furthermore, the housing upper part 10 and the housing lower part 11 each have a supply region 15 which receives a power cable (not shown) for distributing power from the battery.

Arranged in the housing between the housing upper shell 10 and the housing lower shell 11 is a contact 16 which has a contact portion 17 and a helical spring contact 20. The contact portion 17 comprises a contact strip 18 which is bent substantially into a cylindrical portion. The contact strip 18 is preferably made from an electrically conductive material, such as a conductive metal.

The contact portion 17 also has a power supply portion 19 for making contact with the power cable.

To make contact between the battery terminal and the plug connector, the helical spring contact 20 is arranged in the interior of the cylindrical portion of the contact strip 18. When contact is made between the plug connector and the cylindrical portion or post 2 of the battery terminal, the spring contact 20 cooperates with the contact strip 18 and the contact ring 3 to make an electrical connection between the contact portion 17 of the plug connector and the contact ring 3 of the battery terminal.

When the plug connector is placed on the cylindrical portion of the battery terminal, the helical contact spring 20 initially slides along the protective cap 4 toward the copper contact ring 3.

The diameters of the cylindrical portion or post 2 and the cylindrical contact strip 18 are selected such that in the mated state the windings of the helical spring contact 20 are tilted beyond their normal angle of tilt in the direction of the spring axis. This means that a restoring force acts on both the cylindrical portion or post 2 of the plug connector and the inner face of the contact strip 18. The cylindrical portion or post 2 and the contact strip 18 are electrically connected by each winding of the helical spring contact 20 in compressed contact with both the cylindrical portion or post 2 and the contact strip 18.

Figure 5:
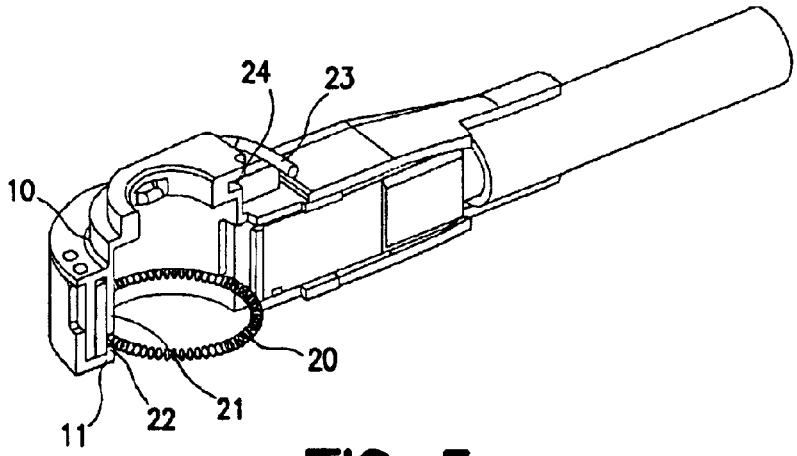
FIG. 5 shows a cut-away view of the plug connector in the assembled condition.

To prevent the helical spring contact 20 from moving in the direction of the axis of the cylindrical region formed by the contact strip 18, the helical spring contact 20 may be fixed with respect to the contact strip 18. As illustrated in FIG. 5, the housing upper part 10 has a first holding element 21 and the lower housing part 11 has a second holding element 22. In the assembled state of the plug connector, the first and the second holding elements 21, 22 lie substantially opposite one another in the interior of the cylindrical region of the plug connector and form a recess in which the helical spring contact 20 is held. The first and the second holding elements 21, 22 therefore form the cylindrical region in the plug connector in which the cylindrical portion or post 2 is arranged in the mated state. The width of the recess formed by the first and the second holding elements 21, 22 corresponds substantially to the width of the helical spring contact 20.

The plug connector may be secured to the battery terminal by a spring 23 which is disposed in a groove 24 in the housing upper shell 10 and cooperates with the narrowed portion 5 on the protective cap 4. When the plug connector is put on the cylindrical portion or post 2 of the battery terminal, the spring 23 is opened by sliding contact along the oblique face 6 of the protective cap 4. The spring 23 then latches in the narrowed portion 5. The plug connector is moved in the direction of the axis of symmetry of the cylindrical portion or post 2 during mating.

Figure 6:
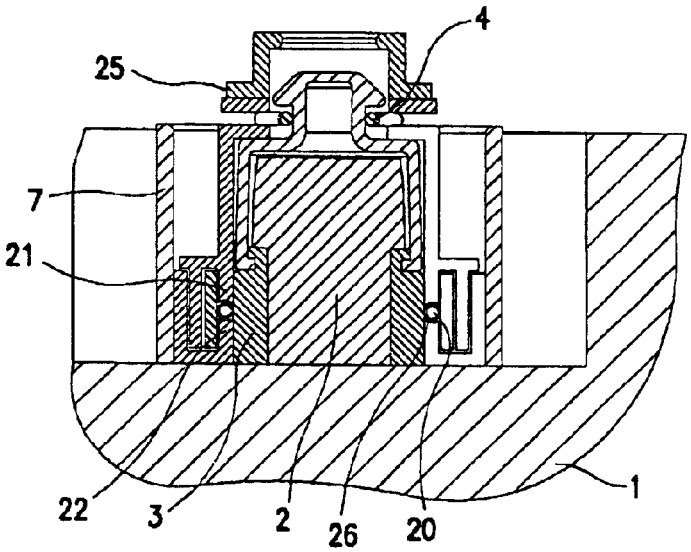
FIG. 6 shows a sectional view of the plug connector placed on a battery terminal.
Figure 7:
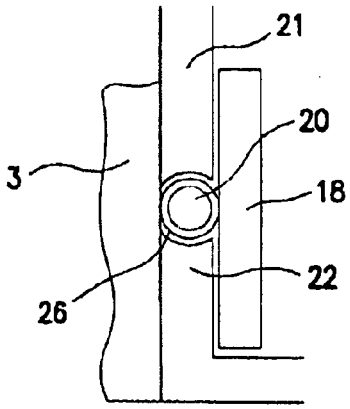
FIG. 7 shows an enlarged illustration of the recess region formed by the holding elements.

FIG. 6 illustrates a cross-section through a plug connector in a mated state with a battery terminal. A recess 26 is formed by the first holding element 21 and the second holding element 22. The helical spring contact 20 is located in the recess 26. To contain the helical spring contact 20 in the plug connector during mating and de-mating of the plug connector, the end faces of the first and the second holding elements 21, 22 forming the recess 26 have a ramp that tapers in the direction of the axis of the cylindrical region. The recess 26, as illustrated in FIG. 7, tapers enough to contain the inserted helical spring contact 20 in the recess 26. The tapered ramps on the end face of the first and/or the second holding element 21, 22 resist removal of the helical spring contact 20 from the recess in the direction of the interior of the cylindrical region.

The housing upper shell 10 and the housing lower shell 11 are latched together in the assembled state and receive the contact 16 between them. For the purpose of latching, the housing upper shell 10 and the housing lower shell 11 have complementary latching elements 12, 13. In an exemplary embodiment of the invention, as shown in FIG. 4, latching elements 12, 13 are provided both in the supply region 15 and in the contact region 14 surrounding the cylindrical portion or post 2.

Provided on the housing upper shell 10 are two flexible arms 25, as shown in FIG. 4 which have the groove 24 (shown in FIG. 5) for receiving the spring 23. When these flexible arms 25 are pressed together, the spring 23 can be opened by a lever action and the plug connector can be removed from the battery terminal. It is particularly advantageous that, in the mated state, the entire plug connector is arranged within the protective ring 7, as a result of which a great deal of space can be saved.

The plug connector according to the present invention has the advantage that the upper and lower shells 10, 11, which are electrically non-conductive, completely surround the contact 17, hence forming a contact protection means.

Moreover, a plug connector of this kind can be constructed in a simple way, since the upper and lower shells only need each to have a holding element in order to hold the helical spring contact. Other measures for fixing the helical spring contact to the contact element are not therefore necessary. Instead, the spring contact is held, when the upper shell and lower shell are in the assembled state, in a recess formed by the holding elements. Thus, when the plug connector is mated on the cylindrical portion or post of the battery terminal, the helical spring contact cannot be pushed in the axial direction of the cylindrical region of the plug connector. Accordingly the helical spring contact is prevented from being withdrawn from the cylindrical region of the contact strip when the plug connector is removed from the battery terminal.

According to a further preferred embodiment, one of the holding elements or both holding elements are shaped such that the recess tapers in the direction of the interior of the cylindrical region in order to resist removal of the helical spring from the recess in an inward direction. In this way, the risk that the helical spring contact of the plug connector will become detached from the recess formed by the holding elements when the plug connector is unmated is reduced.

We claim:

1. A plug connector for making an electrical connection with a battery terminal, the plug connector comprising:

a housing with an upper shell, and a lower shell; and a contact lying within the housing and having a contact strip bent to form a cylindrical region and a helical spring contact disposed within the cylindrical region of the contact strip and sized to contact both the contact strip and the battery terminal;

Wherein the upper shell and the lower shell each have a holding element extending within the cylindrical region formed by the contact strip to form a recess for holding the helical spring contact.

2. The plug connector according to claim 1, wherein the helical spring contact abuts within the cylindrical region of the contact strip.

3. The plug connector according to claim 1, wherein at least one of the holding elements is shaped such that the recess tapers in the direction of the interior of the cylindrical region in order to retain the helical spring contact in the cylindrical region.

4. The plug connector according to claim 3, wherein both holding elements, at ends thereof, are tapered in the direction of the interior of the cylindrical region in order to retain the helical spring contact in the cylindrical region.

5. The plug connector according to claim 1, wherein at least one of the upper shell and the lower shell have recesses for receiving corresponding projections disposed on a protective ring surrounding a cylindrical portion of the battery terminal.

6. The plug connector according to claim 1, wherein the housing upper shell and the housing lower shell have complementary latching elements to latch them together in the assembled state.

7. A plug connector according to claim 1, wherein the housing upper shell has two flexible arms thereon with a grooves therein for receiving a spring to retain the plug connector on the battery terminal, the spring being releasable by pressing the flexible arms are together.

8. A plug connector according to claim 1, wherein the plug connector is configured such that the entire plug connector can be arranged within a protective ring of the battery terminal.

9. A plug connector according to claim 1, wherein the upper and lower shells completely surround the contact.

* * * * *